US009802200B2

(12) United States Patent
Taylor et al.

(10) Patent No.: US 9,802,200 B2
(45) Date of Patent: Oct. 31, 2017

(54) TUBE RACK TOOL

(71) Applicant: BioFire Defense, LLC, Salt Lake City, UT (US)

(72) Inventors: Logan M. Taylor, Roy, UT (US); Richard David Abbott, Draper, UT (US)

(73) Assignee: BioFire Defense, LLC, Salt Lake City, UT (US)

( * ) Notice: Subject to any disclaimer, the term of this patent is extended or adjusted under 35 U.S.C. 154(b) by 0 days.

(21) Appl. No.: 15/110,172

(22) PCT Filed: Feb. 11, 2016

(86) PCT No.: PCT/US2016/017620
§ 371 (c)(1),
(2) Date: Jul. 7, 2016

(87) PCT Pub. No.: WO2016/137756
PCT Pub. Date: Sep. 1, 2016

(65) Prior Publication Data

US 2017/0001198 A1 Jan. 5, 2017

Related U.S. Application Data

(63) Continuation of application No. 14/998,015, filed on Feb. 24, 2015, now abandoned.

(51) Int. Cl.
*B01L 9/06* (2006.01)

(52) U.S. Cl.
CPC ..... *B01L 9/06* (2013.01); *B01L 2200/025* (2013.01); *B01L 2200/04* (2013.01)

(58) Field of Classification Search
CPC ..... B01L 9/06; B01L 2200/025
See application file for complete search history.

(56) References Cited

U.S. PATENT DOCUMENTS 3,443,396 A * 5/1969 Ziolkowski ..... B01L 7/02 62/377
3,627,170 A * 12/1971 Pulliam ..... B65D 21/0219 206/508

(Continued)

OTHER PUBLICATIONS

U.S. Appl. No. 29/555,675, filed Feb. 24, 2016, Taylor et al.

(Continued)

*Primary Examiner* — Paul Hyun
(74) *Attorney, Agent, or Firm* — Workman Nydegger

(57) ABSTRACT

Tools and methods are provided for removing a plurality of tubes from a rack of tubes. Tube rack tools include a base and/or top piece for receiving the rack of tubes. The base has a support surface for engaging the closed bottom of the plurality of tubes. The support surface can be curved such that the rack of tubes can be rocked about the curves support surface to dislodge the plurality of tubes from the rack. The top piece can be configured to engage the rack such that pressure on the top piece in the direction of the support surface applies a pressure on the rack without applying the pressure to the tubes. The tubes are dislodged from the rack by application of the pressure. Elements of the tube rack tool are also configured for securing the tubes within the rack or caps to the tubes.

32 Claims, 7 Drawing Sheets

(56) References Cited

U.S. PATENT DOCUMENTS

| | | | | |
|---|---|---|---|---|
| 3,915,296 | A * | 10/1975 | Spencer | B65D 85/816 206/217 |
| 4,124,122 | A | 11/1978 | Emmitt | |
| 4,453,639 | A | 6/1984 | Sharma | |
| 5,632,388 | A | 5/1997 | Morrison et al. | |
| D466,219 | S | 11/2002 | Wynschenk et al. | |
| D628,305 | S | 11/2010 | Gorrec et al. | |
| 8,142,740 | B2 | 3/2012 | Self et al. | |
| 8,430,251 | B2 | 4/2013 | Fry et al. | |
| D686,749 | S | 7/2013 | Trump | |
| D710,024 | S | 7/2014 | Guo | |
| D729,404 | S | 5/2015 | Teich et al. | |
| 2002/0108917 | A1 | 8/2002 | Maruyama | |
| 2005/0180895 | A1* | 8/2005 | Itoh | B01L 9/06 422/400 |
| 2005/0236346 | A1 | 10/2005 | Whitney | |
| 2007/0297950 | A1 | 12/2007 | Hochstrasser et al. | |
| 2009/0293643 | A1* | 12/2009 | Powell | B01L 9/543 73/863.01 |

OTHER PUBLICATIONS

U.S. Appl. No. 29/555,675, Jan. 27, 2017, Office Action.
International Search Report and Written Opinion, US International Search Authority, PCT/U52016/017620, Completed Mar. 31, 2016.
Eppendorf Capping Aid, Thermal Scientific, Inc. accessed as early as Jul. 19, 2016 http://www.thermalscientific.com/general-lab-supplies/molecular-technology/molecular-capping-aid/eppendorf-capping-aid.
Micronic Tube Selector rapidly and securely picking of sample storage tubes! Accessed as early as Jul. 19, 2016.
U.S. Appl. No. 29/555,675, Apr. 12, 2017, Notice of Allowance.

* cited by examiner

TUBE RACK TOOL

CROSS-REFERENCE TO RELATED APPLICATIONS

The present application claims priority to PCT Application No. PCT/US2016/017620, filed Feb. 11, 2016, entitled "TUBE RACK TOOL", which claims priority to U.S. patent application Ser. No. 14/998,015, filed Feb. 24, 2015, entitled "TUBE REMOVAL TOOL". All the aforementioned applications are incorporated by reference herein in their entirety.

BACKGROUND

1. Technical Field

Embodiments of the present disclosure relate generally to tube rack tools for dislodging a plurality of tubes from a rack of tubes, and more specifically for synchronously dislodging a plurality of tubes from a rack of tubes, and methods for using the same.

2. Background and Relevant Art

A microtiter plate is a flat plate with multiple "wells" used as small test tubes or used to receive tubes therein. The microtiter plate has become a standard tool in analytical research and clinical diagnostic testing laboratories. A microtiter plate typically has 6, 24, 96, 384, 1536, 6144, or 24576 sample wells arranged in a 2:3 rectangular matrix. Some microtiter plates have even been manufactured with 3456 or even 9600 wells, although 96 wells, provided in an 8×12 arrangement is the most common.

Depending on the size, each well typically holds somewhere between a few nanoliters to several hundred milliliters of liquid or an equivalent amount of a solid sample, such as a dry powder. Accordingly, some plates have wells with closed bottoms. In certain embodiments, plates may be provided as racks to support glass or plastic tube or tube strip inserts. In such embodiments, the wells can alternatively have open bottoms. Illustrative wells can be circular (including cylindrical or conical) or square in cross-section. Pipettes (e.g., multi-channel pipettes) have been developed to pipette measured liquids into an entire row of wells at a time. PCR devices and other instruments for a wide variety of laboratory applications have been developed to receive microtiter plates of standard sizes and to process samples contained in the wells therein. A number of companies have even developed robots specifically configured to handle microtiter plates.

Microtiter plates often are provided with wells formed in the plate. The most common manufacturing process is injection molding, used typically for polystyrene, polypropylene and cyclo-olefin. However, microplates may be made from a variety of polymers, as is appropriate to withstand a wide temperature range and provide chemical resistance.

More recently, plates have become available that include a rack and a plurality of strips or individual tubes, a common configuration being twelve strips of eight tubes (or eight strips of twelve tubes). Such an arrangement may make it easier to use a portion of a plate or to prepare smaller groups of reactions within a single plate. Often, the spacing of the tubes results in standard spacing of wells of a 96-well microtiter plate, and the rack and tubes, once assembled, are compatible with the myriad tools and instrumentation that have been developed for use with microtiter plates.

One example of a rack and tubes is the Loborack-96 (Micronic North America, McMurray, Pa.). The Loborack-96 can hold, for example, 96 individual tubes (for example, 0.50 ml or 0.75 ml tubes), eight strips of twelve tubes, or twelve strips of eight tubes, in a 96-well configuration. Each tube may be individually capped, or each strip may be capped with a strip of eight or twelve caps, respectively. While the tubes are disposable and are intended as single-use items, the rack is reusable. However, it can be difficult to remove the tubes from the rack manually, and tubes often open as they are removed, potentially contaminating the tube contents or spilling hazardous or contaminating materials. While Micronic sells a tool for removing one tube at a time, a tool that removes rows of tubes or all tubes quickly and easily is desired.

BRIEF SUMMARY

In one aspect of the present disclosure, a tube rack tool is provided, the tube rack tool comprising a base for receiving a rack of tubes (the rack of tubes illustratively comprising a rack and a plurality of tubes disposed in the rack), the base having a surface for engaging the tubes, wherein pressure on the rack dislodges a plurality of tubes from the rack. For instance, in some embodiments, the plurality of tubes can be simultaneously, concurrently, synchronously, and/or immediately sequentially (e.g., instantaneously) dislodged from the rack. In at least one embodiment, the rack of tubes can be positioned atop the surface such that the surface engages a bottom (e.g., closed end) of the plurality of tubes, optionally without engaging at least a portion of the rack such that a substantially or at least partially downward force (e.g., pressure) on the rack dislodges the plurality of tubes from the rack. In certain embodiments, the tube rack tool may further comprise a top piece configured to provide the force on at least a portion of the rack. Various surface and/or other configurations are provided for the tube rack tool.

In another aspect, a tube rack tool is provided comprising a top piece for receiving a rack of tubes therein, and a base having a surface for engaging a plurality of the tubes in the rack of tubes, wherein pressure on the top piece (e.g., in the direction of the surface) dislodges the plurality of tubes from the rack.

In yet another aspect, a method of removing a plurality of tubes from a rack of tubes having a rack and a set of tubes is provided, the method comprising placing the rack of tubes into a base, the base having a surface for engaging the plurality of the tubes in the rack of tubes, and providing pressure on the rack to dislodge the plurality of tubes from the rack.

Additional features and advantages of the embodiments of the present disclosure will be set forth in the description which follows or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other advantages and features of the present disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 2:
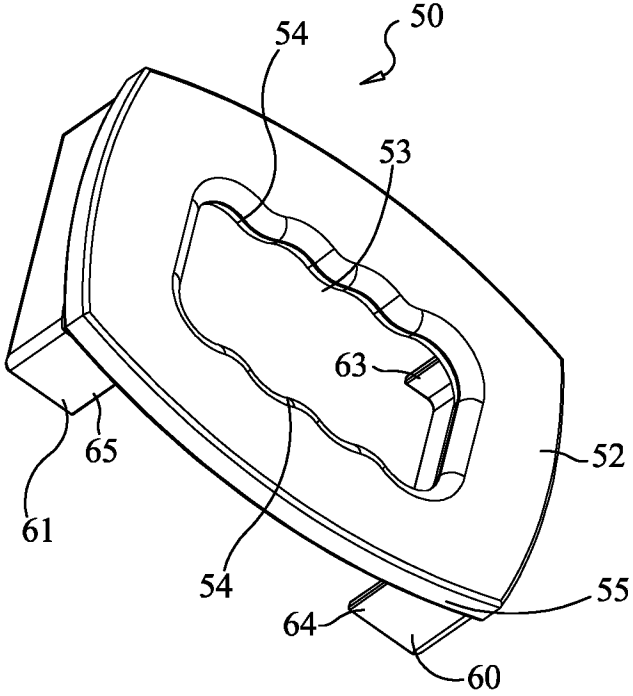
FIG. 2 is a perspective view of a top piece for use with the base of FIG. 1.

Before describing example implementations in detail, it is to be understood that this disclosure is not limited to parameters of the particularly exemplified systems, methods, apparatus, products, processes, compositions, and/or kits, which may, of course, vary. It is also to be understood that the terminology used herein is only for the purpose of describing particular implementations of the present disclosure, and is not necessarily intended to limit the scope of the disclosure and/or invention in any manner. Thus, while the present disclosure will be described in detail with reference to specific configurations, the descriptions are illustrative only and are not to be construed as limiting the scope of the claimed invention. For instance, certain implementations may include fewer or additional components than those illustrated in the accompanying drawings and/or described in the written description. Furthermore, various modifications can be made to the illustrated configurations without departing from the spirit and scope of the invention as defined by the claims. Thus, while various aspects, embodiments, and/or implementations of the disclosure are described and/or disclosed herein, other aspects, implementations, and embodiments are also contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary implementations. As used herein, the term "exemplary" means "serving as an example, instance, or illustration," and should not necessarily be construed as preferred or advantageous over other implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "tile" includes one, two, or more tiles. Similarly, reference to a plurality of referents should be interpreted as comprising a single referent and/or a plurality of referents unless the content and/or context clearly dictate otherwise. Thus, reference to "tiles" does not necessarily require a plurality of such tiles. Instead, it will be appreciated that independent of conjugation; one or more tiles are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

As used herein, directional and/or arbitrary terms, such as "top," "bottom," "left," "right," "up," "down," "upper," "lower," "inner," "outer," "internal," "external," "interior," "exterior," "proximal," "distal" and the like can be used solely to indicate relative directions and/or orientations and may not be otherwise intended to limit the scope of the disclosure, including the specification, drawings, and/or claims.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated.

It is also understood that various implementations described herein can be utilized in combination with any other implementation described or disclosed, without departing from the scope of the present disclosure. Therefore, products, members, elements, devices, apparatus, systems, methods, processes, compositions, and/or kits according to certain implementations of the present disclosure can include, incorporate, or otherwise comprise properties, features, components, members, elements, steps, and/or the like described in other implementations (including systems, methods, apparatus, and/or the like) disclosed herein without departing from the scope of the present disclosure. Thus, reference to a specific feature in relation to one implementation should not be construed as being limited to applications only within said implementation.

It will also be appreciated that where multiple possibilities of values or a range a values (e.g., less than, greater than, at least, or up to a certain value, or between two recited values) is disclosed or recited, any specific value or range of values falling within the disclosed range of values is likewise disclosed and contemplated herein.

The headings used herein are for organizational purposes only and are not meant to be used to limit the scope of the description or the claims. To facilitate understanding, like reference numerals have been used, where possible, to designate like elements common to the figures. Furthermore, where possible, like numbering of elements have been used in various figures. Furthermore, alternative configurations of a particular element may each include separate letters appended to the element number.

Figure 1:
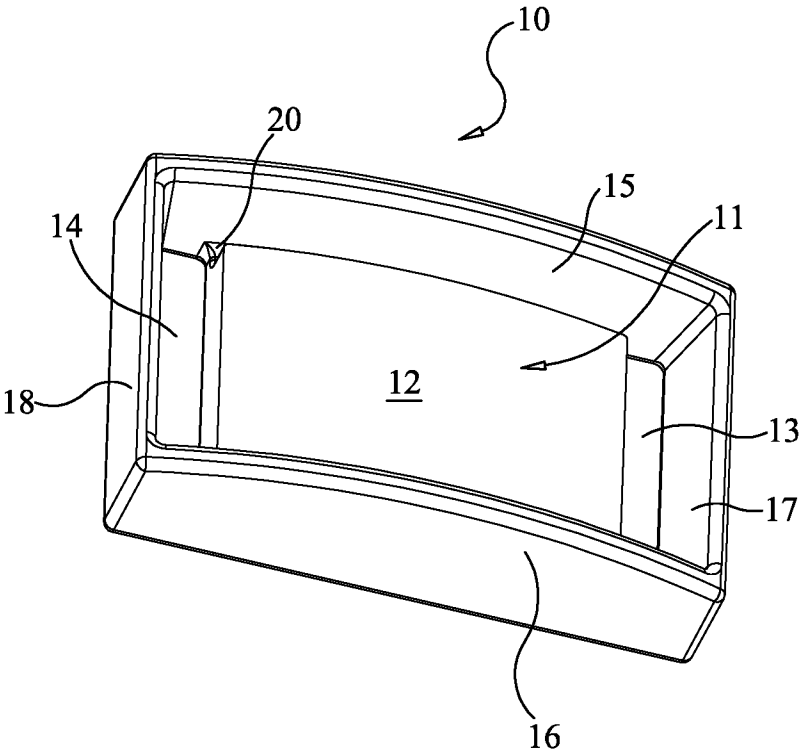
FIG. 1 is a perspective view of a base for an illustrative tube rack tool.

FIG. 1 shows a base 10 of an illustrative tube rack tool 8 (see FIG. 3) according to an embodiment of the present disclosure. The base has a support surface 12, and four walls 15, 16, 17, 18, which surround a rack-receiving area 11 for receiving a rack of tubes. In the illustrative embodiment, support surface 12 is curved along an axis extending in the direction from wall 18 to wall 17. In some embodiments, support surface 12 can (also or alternatively) be curved along an axis extending in the direction from wall 16 to wall 15. As discussed further below, however, support surface 12 need not have a curved configuration in certain embodiments. Also in the illustrative embodiment, two spacings 13, 14 are provided between support surface 12 and walls 17, 18, respectively. Spacings 13, 14 comprise openings through base 10, although optionally openings 13, 14 may be provided with bottoms to result in recesses. Opposing recesses 20 are also disposed between support surface 12 and walls 15, 16, respectively. It is understood that walls 15, 16, 17, and 18, as well as spacings 13, 14, and recesses 20 are provided to aid in placement and retention of a rack (of tubes) within rack-receiving area 11, and that any or all of these walls, spacings, and/or recesses are optional and may be omitted. Similarly, the walls need not entirely surround the rack-receiving area 11 in some embodiments.

Figure 3:
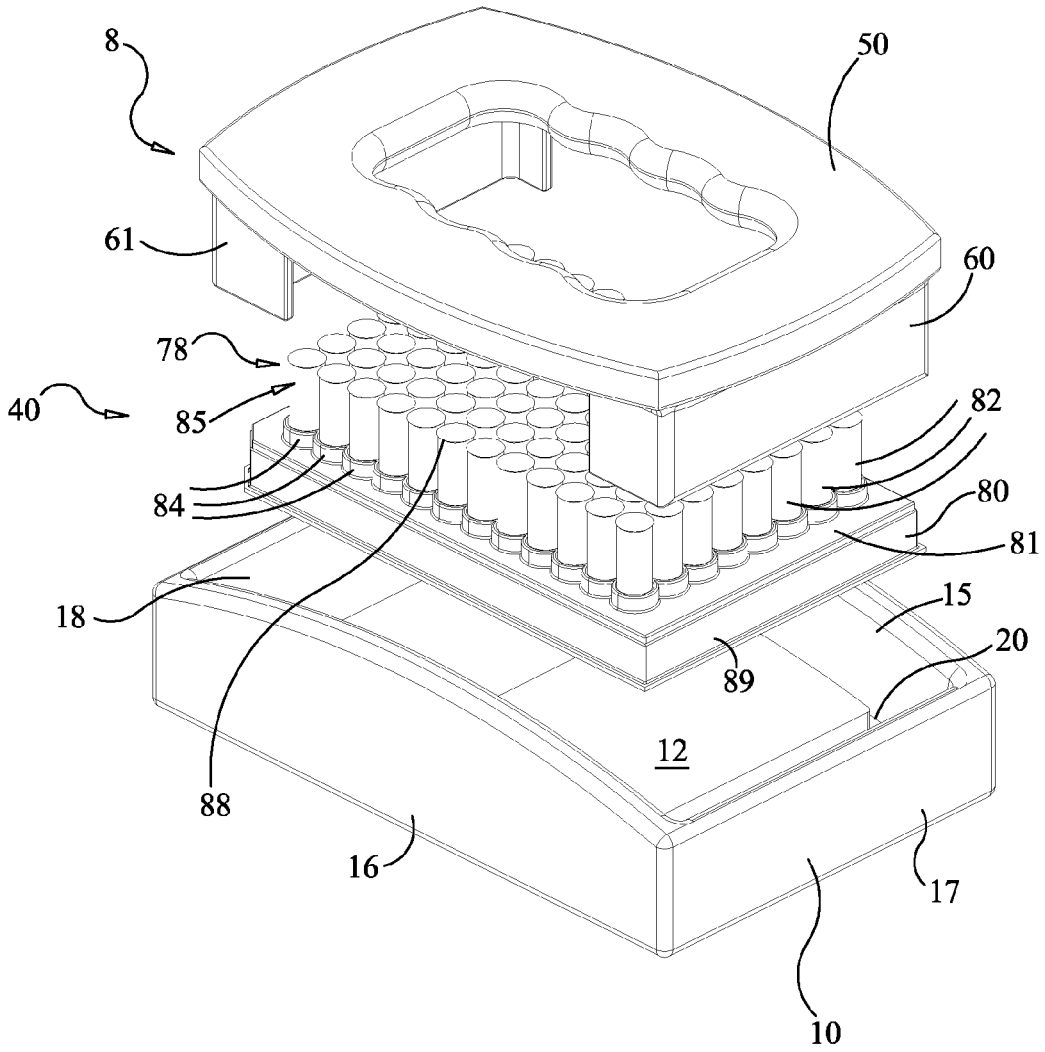
FIG. 3 is an exploded perspective view of a rack of tubes inserted between the base of FIG. 1 and the top piece of FIG. 2.

FIG. 2 shows a top piece 50 that may be used with base 10 (e.g., to form the tube rack tool 8 of FIG. 3). Top piece 50 has a top 52, and two legs 60, 61 extending downward from top 50. Legs 60, 61 are spaced to receive a rack of tubes therebetween. In alternative embodiments, top piece 50 can have a single leg or more than two legs extending downward therefrom. For example, a single leg can extend (entirely or partially) about top piece 50 and/or extend downward therefrom. Alternatively, three or four legs can be disposed at corners of top piece 50.

In the illustrative embodiment depicted, leg 60 is provided with leg extensions 63, 64, and leg 61 is provided with leg extension 65 (and a second leg extension not shown in FIG. 2). As best seen with leg extension 63, the leg extensions project inward from each leg (e.g., toward the opposing leg). The leg extensions may be provided to aid in containing and/or properly positioning the rack of tubes between legs 60, 61, and/or restrain the rack of tubes from slipping sideways out of top piece 50. As discussed in further detail below, the leg extensions may also aid in properly positioning the rack of tubes about support surface 12 of base 10 (FIG. 1). Optionally, instead of or in addition to the leg extensions, top piece 50 may be provided with side walls extending between legs 60 and 61 to contain the rack of tubes.

FIG. 3 shows an exploded view of a tube removal tool assembly 40 comprising a rack of tubes 78 including rack 80 and ninety-six tubes 82 being inserted between base 10 and top piece 50. It is understood that while illustrative rack 80 includes space for ninety-six tubes, any other number or arrangement of a rack and tubes may be used. Moreover, while illustrative rack of tubes 78 is full, the illustrative embodiments may be used with a partially full rack of tubes. As discussed above, walls 15, 16, 17, 18 of base 10 are sized to receive rack of tubes 78 therein, thereby supporting rack of tubes 78 on support surface 12. As top piece 50 is placed over rack of tubes 78, legs 60, 61 of top piece 50 extend down at least partially around tubes 82, fit inside walls 15, 16, 17, 18, and assist with maintaining the orientation of rack 80 and tubes 82 relative to base 10 and/or support surface 12 thereof.

In this illustrative example, rack 80 is provided with twelve rows 85 of eight tubes 82, although it is understood that other configurations are within the scope of this disclosure. Each tube 82 has an open top portion 88 and a closed opposing bottom portion 90 (see FIG. 4) inserted into its respective well 84 in rack 80. Wells 84 comprise openings in a surface portion 81 of rack 80, and each tube 82 or a bottom portion 90 thereof (see FIG. 4) extends below surface portion 81. As best seen in the cross-sectional view of FIG. 4, a skirt 89 functions as a stand for rack 80, extending below any bottom 90 of tubes 82. Thus, when rack 80 is placed on a lab bench or other flat surface, tubes 82 are spaced apart from that surface, to prevent tubes 82 from inadvertently dislodging from rack 80.

Figure 10:
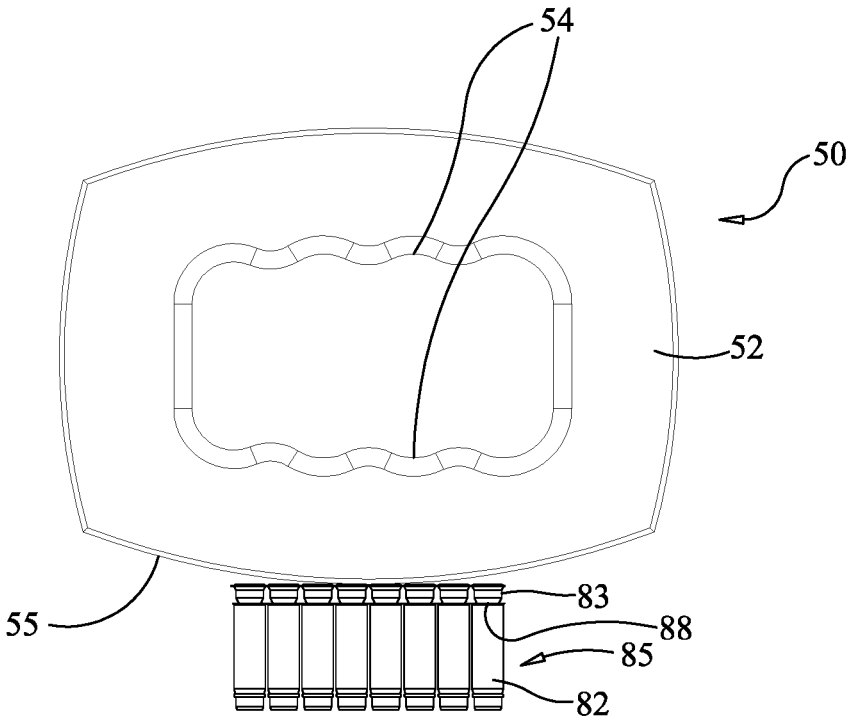
FIG. 10 shows a row of tubes with caps, and a top piece positioned to apply pressure to the caps.
Figure 11:
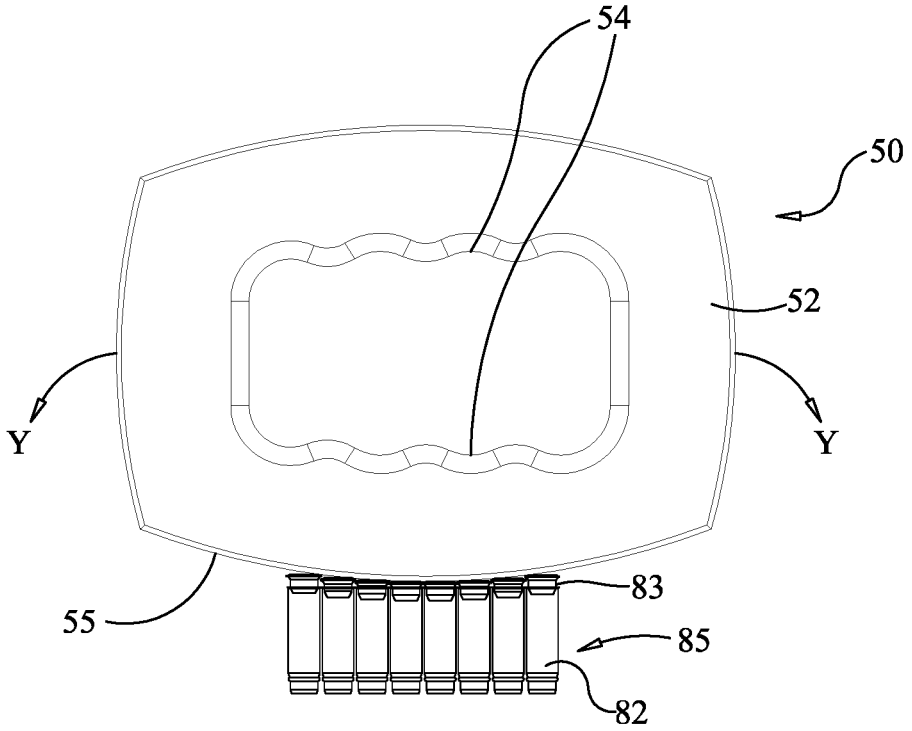
FIG. 11 is similar to FIG. 10, except that the caps are in process of being seated by pressure from the top piece.

It is understood that while only two walls of skirt 89 are visible in FIG. 3, rack 80 may have a skirt 89 having two, three, or four walls, or may have feet or other bottom projections to function to keep tubes 82 elevated. Tubes 82, may be of any configuration, illustratively with flat bottoms, rounded bottoms, or conical bottoms. Tubes 82 may snap into rack 80, or may be held in place by pressure. While not shown in FIGS. 3-5, tubes 82 may be provided with caps, illustratively which may be screw caps, press fit caps, strip caps, or film adhered to or heat-sealed to tubes 82. For instance, in at least one embodiment, as shown in FIGS. 10-11, tubes 82 can have sealing cap(s) 83 disposed thereon and/or attached thereto (e.g., sealing the upper open portions 88 thereof). Other configurations are also contemplated within the scope of this disclosure.

Figure 4:
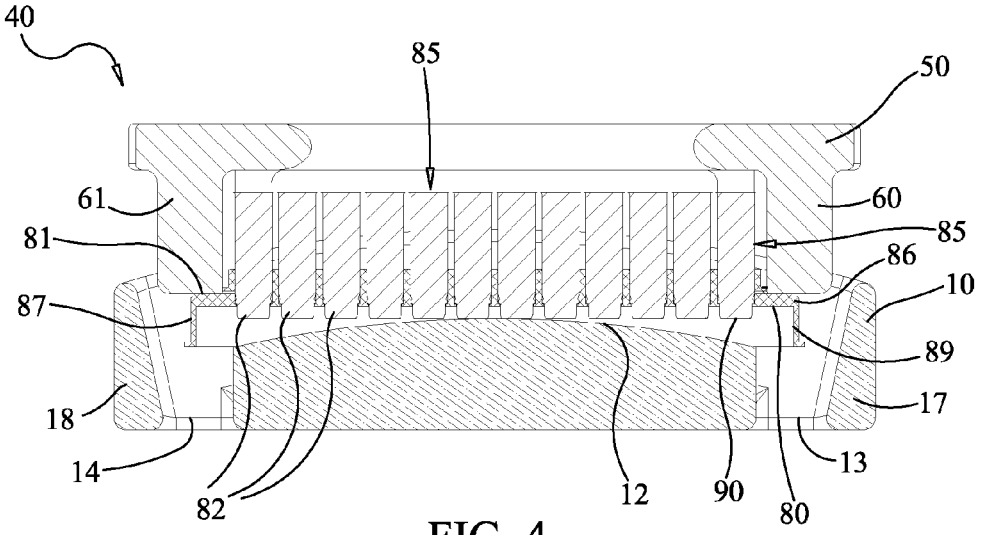
FIG. 4 is a cross-sectional view of a rack of tubes inserted between the base of FIG. 1 and the top piece of FIG. 2.

FIG. 4 shows a cross-sectional view of a tube removal tool assembly 40, including rack of tubes 78 inserted into base 10, and top piece 50 fitted on top of rack of tubes 78, with legs 60, 61 engaging rack 80 at upper surface portion 81. Because of the curvature of support surface 12, only a portion of the rows 85 of tubes 82 are in contact with support surface 12. In this illustrative embodiment, ends 86, 87 of rack 80 are cantilevered over openings 13, 14. Shown in FIGS. 1 and 3, a recess 20 between support surface 12 and wall 15 allows skirt 89 of rack 80 to extend below support surface 12. A similar recess (not shown) may be provided between support surface 12 and wall 16. Accordingly, in at least one embodiment, support surface 12 of base 10 engages a plurality of tubes 82 (or bottom portion(s) thereof) but does not engage and/or contact at least a portion of skirt 89 of rack 80.

Figure 5:
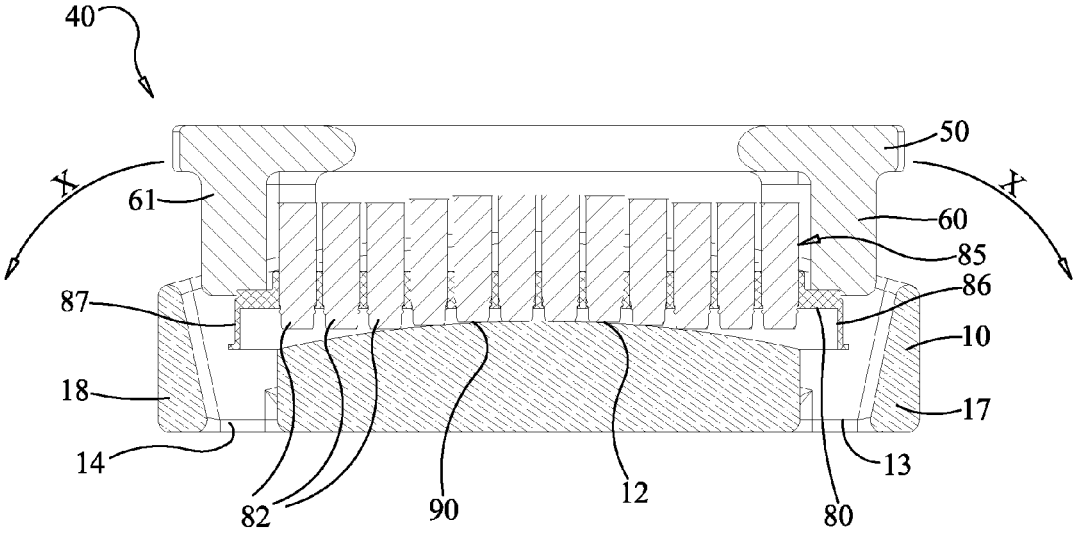
FIG. 5 is similar to FIG. 4, except that pressure has been exerted on the top piece and some of the tubes are being removed from the rack.

Downward pressure (e.g., from above) on top piece 50 causes one or more rows 85 of tubes 82 (or bottom portion(s) thereof) to engage support surface 12 of base 10, which in turn causes one or more (rows 85 of) tubes 82 to begin to dislodge from rack 80, as shown in FIG. 5. Accordingly, a plurality of tubes 82 (e.g., at least one row 85) can be simultaneously, concurrently, and/or synchronously dislodge from the rack. In an illustrative embodiment, a back-and-forth rocking motion about or along the curvature of support surface 12, as indicated by arrows X-X, causes additional rows 85 of tubes 82 to engage support surface 12 of base 10, which in turn causes the additional rows 85 of tubes 82 to dislodge from rack 80. As pressure is placed more directly over leg 60, pressure is placed more directly over cantilevered end 86, which may deflect toward opening 13 (e.g., without engaging support surface 12 of base 10), thereby releasing the row 85 closest to end 86. As top piece 50 is rocked in the other direction and pressure is placed more directly over leg 61, pressure is placed more directly over cantilevered end 87, which may deflect toward opening 14 (e.g., without engaging support surface 12 of base 10), thereby releasing the row 85 closest to end 87. Continued back-and-forth motion causes all tubes 82 to loosen from rack 80, ultimately dislodging all tubes 82 from rack 80. Accordingly, a plurality of tubes 82 and/or rows 85 of tubes 82 can be simultaneously, concurrently, synchronously, and/or immediately sequentially (e.g., instantaneously) dislodged from the rack 80. The rack 80 and tubes 82 may then be removed from base 10 and top piece 50.

In the embodiment illustrated in FIGS. 1 and 3-5, support surface 12 is curved. While the illustrative curvature is an arc of a circle having a radius of approximately 20 inches, it is understood that this is illustrative only, and that other curvatures would be operational, illustratively having a radius of 15 inches to 25 inches, 10 inches to 30 inches, or 7 inches to 40 inches. While circular curvatures are used in certain embodiments herein, it is understood that other shapes are within the scope of this disclosure, including parabolic, and curved in two dimensions. In one illustrative embodiment, support surface 12 may be planar, provided that support surface 12 is smaller than skirt 89. It is understood that flatter support surfaces can dislodge more tubes at once but may require more pressure, while more curved support surfaces may dislodge fewer tubes at once, but may also require less pressure. Furthermore, curvature in one direction can dislodge tubes by rows, while curvature in both directions may allow dislodging of a single tube or a small group of tubes.

It is understood that in some embodiments top piece 50 may be optional, and insertion of rack 80 into base 10 may allow for removal of tubes 82 by manual pressure directly on ends 86, 87 of rack 80 or on skirt 89 (e.g., pressure on surface 81 in the direction of support surface 12). For instance, in at least one embodiment, pressure can be applied to surface 81, illustratively by one or more fingers or hands of an operator or any suitable pressure applicator.

Returning to FIG. 2, in this illustrative embodiment, a top portion 52 of top piece 50 is provided with an opening 53. As best shown in FIGS. 10-11, top portion 52 is also provided with curved edge 55, shaped for pressing on tube caps 83 (e.g., to seal opening 88 with cap 83), and configured for capping a row 85 of tubes 82 with a (downward) force and/or a rocking motion, as indicated by arrows Y-Y in FIG. 11. It is also noted that curved edge 55 can be shaped and/or configured for seating (a row 85 of) tubes 82 into rack 80 (not shown) with a (pressing) force or the rocking motion indicated by arrows Y-Y in FIG. 11. Opening 53 optionally may be provided with grips 54 for comfortably holding top piece 50 during this capping operation.

Figure 12:
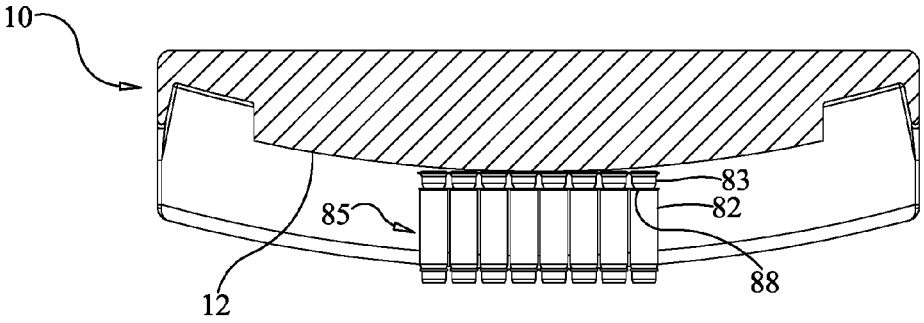
FIG. 12 is a cross-sectional view of a row of tubes with caps, and an inverted base positioned to apply pressure to the caps.
Figure 13:
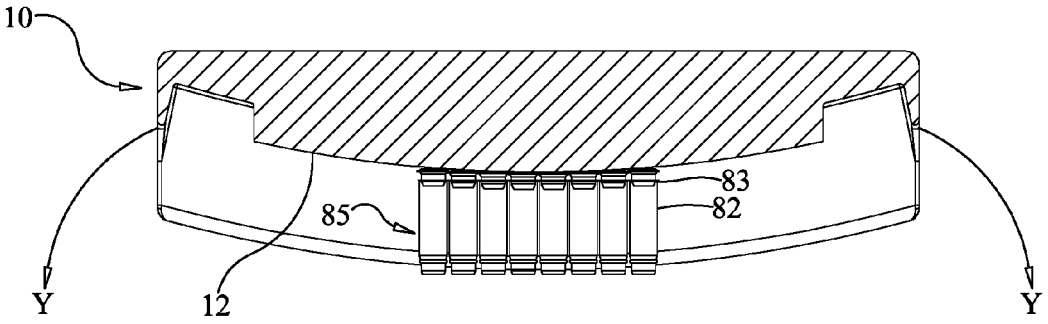
FIG. 13 is similar to FIG. 12, except that the caps are in process of being seated by pressure from the inverted base.

Alternatively, base 10 may be inverted and support surface 12 positioned over (row 85 of) tubes 82 as depicted in FIG. 12. A similar rocking motion, indicated by arrows Y-Y in FIG. 13, and/or (downward) force can be applied for pressing on tube caps 83 (e.g., to seal opening 88 with cap 83). It is also noted that inverted base 10 and/or support surface 12 thereof may be used for seating part or all of the tubes 82 of a rack of tubes 78 into rack 80 (see FIG. 3), or for capping one or more tubes 82 or part or all of one or more rows 85 of tubes 82 in a rack of tubes 78 by placing pressure on base 10 (e.g., using rocking motion Y-Y).

Figure 7:
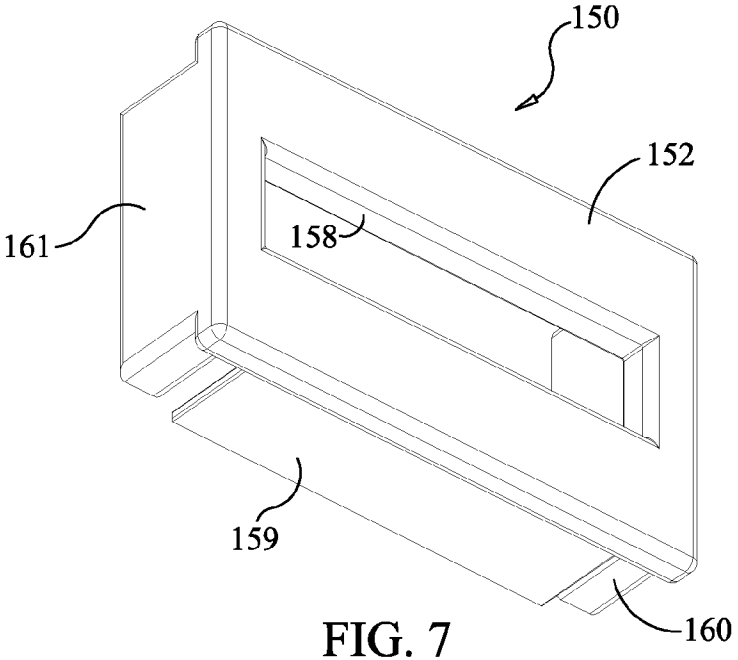
FIG. 7 is similar to FIG. 2, except showing a top piece for an alternate illustrative tube rack tool.
Figure 6:
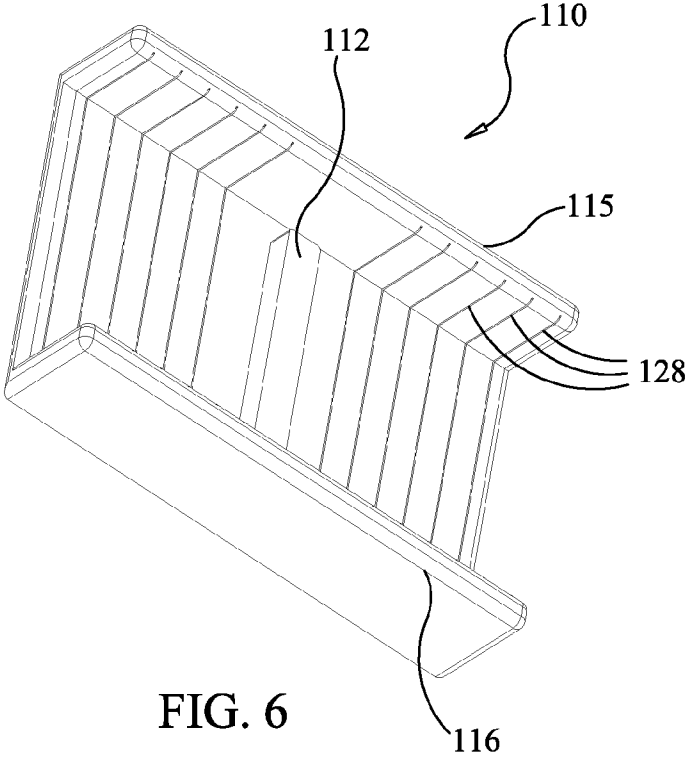
FIG. 6 is similar to FIG. 1, except showing a base for a different illustrative tube rack tool.

FIGS. 6-7 show a base 110 and top piece 150 of an alternative embodiment of a tube removal tool 140, wherein like reference numerals indicate similar components or components having similar functions. The base 110 has a support surface 112, and two walls 115, 116, which define a space for receiving a rack of tubes. Unlike the base 10 of FIG. 1, in this illustrative embodiment, support surface 112 is much narrower and is configured to contact a single row of tubes 85. It is understood that support surface 112 may be provided with any shape to contact any number of tubes or rows of tubes. For instance, support surface 112 can be curved along an axis extending in the direction from wall 116 to wall 115.

Figure 8:
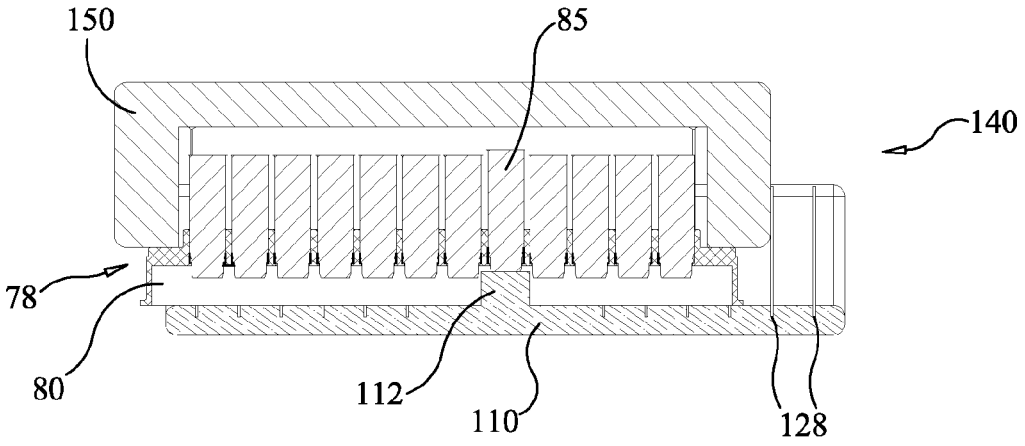
FIG. 8 is similar to FIG. 5 except showing a base and top piece for an alternate illustrative tube rack tool.

FIG. 7 shows a top piece 150 that may be used with base 110, to form a tube rack tool 140, as shown in FIG. 8. Top piece 150 has a top portion 152, and four legs 158, 159, 160, 161 extending downward from top 150. Legs 158, 159, 160, 161 are spaced to receive a rack of tubes 78 therebetween. It is understood that four legs is illustrative only, and that any or all of the legs may be omitted. An embodiment having leg extensions, as in FIG. 2, is also contemplated. It is understood that top piece 150 is not limited to use with base 110, and that the various top pieces described herein may be used with any compatible base, as desired for a specific application. Furthermore, various top pieces described herein may be used without a base. For instance, in at least one embodiment, a rack of tubes can be received by or within a portion of a top piece (e.g., between legs thereof) and a plurality of tubes dislodged from the rack by pressing on the (bottom of) the tubes (e.g., with a hand or other device, apparatus, or element).

Figure 9:
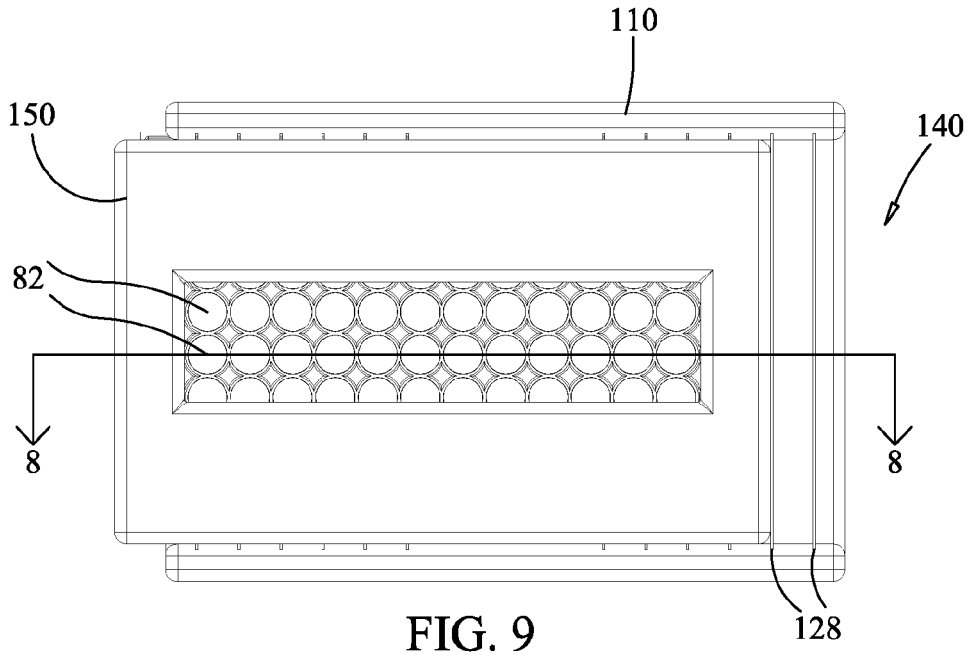
FIG. 9 is a top view of the base and top piece of FIG. 8.

In this illustrative example, only two walls 115, 116 are provided on base 110. The omission of the side walls allows rack 80 and top piece 150 to be moved linearly along base 110. A number of guides 128 are also provided. Lining up rack 80 or top piece 150 with one of the guides 128 will position a specific row of tubes 85 over support surface member 112. As illustratively shown in FIGS. 8-9, lining up top piece 150 even with the second guide 128 positions the fifth row of tubes 85 from that end of top piece 150 over support surface member 112. As best seen in FIG. 8, the row of tubes 85 that is positioned over support surface member 112 is dislodged upon pressure on rack 80 by top piece 150 in the direction of support surface member 112. As with other embodiments, it is understood that top piece 150 is optional, and pressure may be applied by hand or by other means directly to rack 80 to apply pressure to rack 80 to dislodge any tubes 82 that are positioned over support surface member 112.

It is understood that guides 128 may be provided with markings to indicate which row of tubes 85 would be removed when top piece 150 or rack 80 is aligned with each guide. Furthermore, in at least one embodiment, support surface member 112 can be moveable within base 110. For instance, support surface 112 can be disposed on or connected to a movement mechanism configured to permit support surface 112 to be positioned and/or secured at a plurality of positions within base 110. The movement mechanism can comprise a plurality of slots configured to receive a (detachable) support surface member 112, a rail or slide member configured to permit movement of support surface member 112 thereon, or any other means for moving support surface member 112 and/or changing the position thereof with base 110.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, processes, and/or products according to certain embodiments of the present disclosure may include, incorporate, or otherwise comprise properties features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features without necessarily departing from the scope of the present disclosure. Moreover, unless a feature is described as requiring another feature in combination therewith, any feature herein may be combined with any other feature of a same or different embodiment disclosed herein. Furthermore, various well-known aspects of illustrative systems, processes, products, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

What is claimed is:

1. A method of removing a plurality of tubes from a rack of tubes having a rack and a set of tubes, the method comprising:

placing the rack of tubes into a base, the base having a surface for engaging the plurality of the tubes in the rack of tubes;

placing a top piece over the rack of tubes; and providing pressure on the rack to dislodge the plurality of tubes from the rack, wherein the providing pressure step includes applying pressure to the top piece to provide pressure on the rack, thereby dislodging the plurality of tubes.

2. The method of claim 1, wherein the pressure is provided on the rack in the direction of the surface of the base.

3. The method of claim 1, wherein the surface of the base is curved and the providing pressure step includes rocking the top piece, thereby dislodging substantially all of the set of tubes.

4. The method of claim 1, wherein the plurality of tubes is a row of tubes, the surface of the base is shaped to remove the row of tubes, and the applying pressure step dislodges the row of tubes.

5. A method of removing a plurality of tubes from a rack of tubes having a rack and a set of tubes, the method comprising:

placing the rack of tubes into a base, the base having a surface for engaging the plurality of the tubes in the rack of tubes; and providing pressure on the rack to dislodge the plurality of tubes from the rack, wherein the surface is curved and the providing pressure step includes rocking the rack, thereby dislodging substantially all of the set of tubes.

6. The method of claim 5, wherein the pressure is provided on the rack in the direction of the surface of the base.

7. The method of claim 5, further comprising placing a top piece over the rack of tubes, wherein the providing pressure step includes applying pressure to the top piece to provide pressure on the rack, thereby dislodging the plurality of tubes.

8. The method of claim 5, wherein the plurality of tubes is a row of tubes, the surface of the base is shaped to remove the row of tubes, and the applying pressure step dislodges the row of tubes.

9. A method of removing a plurality of tubes from a rack of tubes having a rack and a set of tubes, the method comprising:

placing the rack of tubes into a base, the base having a surface for engaging the plurality of the tubes in the rack of tubes; and providing pressure on the rack to dislodge the plurality of tubes from the rack, wherein the plurality of tubes is a row of tubes, the surface is shaped to remove the row of tubes, and the applying pressure step dislodges the row of tubes.

10. The method of claim 9, wherein the pressure is provided on the rack in the direction of the surface.

11. The method of claim 9, further comprising placing a top piece over the rack of tubes, wherein the providing pressure step includes applying pressure to the top piece to provide pressure on the rack, thereby dislodging the plurality of tubes.

12. The method of claim 11, wherein the surface of the base is curved and the providing pressure step includes rocking the top piece, thereby dislodging substantially all of the set of tubes.

13. A tube removal system, comprising:

a rack of tubes comprising a microtiter plate having a plurality of wells and a plurality of tubes disposed in the wells, the microtiter plate having an upper surface portion disposed about the plurality of wells, the plurality of wells comprising openings in the upper surface portion; and a tube rack tool configured to receive the rack of tubes, the tube rack tool comprising:

a base having a receiving area sized for receiving the rack of tubes, the base having a surface for engaging the plurality of tubes disposed in the wells of the microtiter plate when the rack of tubes is disposed in the receiving area; and a top piece configured for retaining the rack of tubes in engagement with the surface while providing pressure on the microtiter plate, the top piece having one or more legs configured to engage the upper surface portion of the microtiter plate such that pressure applied to the top piece in the direction of the surface dislodges the plurality of tubes from the microtiter plate.

14. The tube removal system of claim 13, wherein the microtiter plate comprises at least 96-wells.

15. The tube removal system of claim 13, wherein the plurality of wells are disposed in rows, the surface of the base being sized to engage all of the tubes disposed in at least one row.

16. The tube removal system of claim 13, wherein the surface is curved such that a rocking motion of the microtiter plate when the pressure is applied to the microtiter plate dislodges substantially all of the tubes from the microtiter plate.

17. The tube removal system of claim 13, wherein the microtiter plate further comprises a skirt disposed about the plurality of wells, the skirt extending from the upper surface portion.

18. The tube removal system of claim 17, wherein the surface of the base is smaller than an area defined by the skirt and is configured to receive the rack of tubes without engaging the skirt, the top piece being configured for providing a greater amount of downward pressure on the upper surface portion than on the plurality of tubes.

19. The tube removal system of claim 13, wherein the surface of the base is configured to engage a bottom surface of the plurality of tubes when the rack of tubes is received by the base.

20. The tube removal system of claim 13, wherein the base is provided with a plurality of guides to aid in positioning the rack of tubes to remove a specific row of tubes.

21. The tube removal system of claim 13, wherein the tube rack tool is sized to receive a 96-well microtiter plate, the rack of tubes comprising the rack and 96 tubes.

22. A tube removal system, comprising:

a rack of tubes comprising:

a microtiter plate having a plurality of wells an upper surface portion disposed about the plurality of wells, the plurality of wells comprising openings in the upper surface portion, and a skirt disposed about the plurality of wells, the skirt extending from the upper surface portion; and a plurality of tubes disposed in the wells; and a tube rack tool configured to receive the rack of tubes, the tube rack tool comprising:

a base having a receiving area sized for receiving the rack of tubes, the base having a surface for engaging the plurality of tubes disposed in the wells of the microtiter plate when the rack of tubes is disposed in the receiving area; and a top piece configured for retaining the rack of tubes in engagement with the surface of the base, wherein the top piece is configured to engage the upper surface portion of the microtiter plate without engaging a top surface of the plurality of tubes when the plurality of tubes are disposed in the wells.

23. The tube removal system of claim 22, wherein the surface of the base is curved.

24. The tube removal system of claim 22, wherein the plurality of wells are disposed in rows, the surface of the base being sized to engage all of the tubes disposed in at least one row.

25. The tube removal system of claim 22, wherein the surface of the base is configured to engage a bottom surface of the plurality of tubes when the rack of tubes is received by the base.

26. The tube removal system of claim 22, wherein the base is provided with a plurality of guides to aid in positioning the rack of tubes to remove a specific row of tubes.

27. A tube removal system, comprising:

a rack of tubes comprising:

a microtiter plate having a plurality of wells, an upper surface portion disposed about the plurality of wells, the plurality of wells comprising openings in the upper surface portion, and a skirt disposed about the plurality of wells, the skirt extending from the upper surface portion; and a plurality of tubes disposed in the wells; and a tube rack tool configured to receive the rack of tubes, the tube rack tool comprising:

a base having a receiving area sized for receiving the rack of tubes, the base having a surface for engaging the plurality of tubes disposed in the wells of the microtiter plate when the rack of tubes is disposed in the receiving area; and a top piece configured for retaining the rack of tubes in engagement with the surface of the base, wherein the surface of the base is smaller than an area defined by the skirt and is configured to receive the rack of tubes without engaging the skirt.

28. A tube rack tool, comprising:

a base having a curved support surface and a wall disposed about the support surface with a space between the wall and the support surface; and a top piece having a top portion and two legs extending from opposing sides of the top portion, the top piece being configured such that a portion of the at least one leg fits in the space between the wall and the support surface, wherein the wall at least partially bounds a receiving area of the base, the support surface being disposed in the receiving area, a first of the two legs being configured to fit in the space between the wall and a first side of the support surface, and a second of the two legs being configured to fit in the space between the wall and a second side of the support surface.

29. The tube rack tool of claim 28, wherein the top portion has at least one curved outer edge.

30. The tube rack tool of claim 28, wherein each of the two legs comprises one or more extensions projecting towards the opposing leg.

31. The tube rack tool of claim 28, wherein each of the two legs comprises one or more extensions projecting towards the opposing leg, the one or more extensions being configured to fit in the space between the wall and a third side of the support surface.

32. The tube rack tool of claim 28, wherein each of the two legs comprises opposing first and second extensions projecting towards the opposing leg, the respective first extensions being configured to fit in the space between the wall and a third side of the support surface, the respective second extensions being configured to fit in the space between the wall and a fourth side of the support surface.

* * * * *